US012449129B2

(12) United States Patent
Iliev et al.

(10) Patent No.: US 12,449,129 B2
(45) Date of Patent: Oct. 21, 2025

(54) BURNER WITH TWO-LAYER VORTEX COUNTERCURRENT FLOW

(71) Applicant: Innorom IV Holdings Innovation and Ventures LTD., Tel Aviv-Jaffa (IL)

(72) Inventors: Roman Lazirovich Iliev, Moscow (RU); Sergei Anatolevich Meshkov, Saint-Petersburg (RU); Boris Vladlenovich Mislavskii, Moscow (RU)

(73) Assignee: Innorom IV Holdings Innovation and Ventures LTD., Tel Aviv-Jaffa (IL)

( * ) Notice: Subject to any disclaimer, the term of this patent is extended or adjusted under 35 U.S.C. 154(b) by 0 days.

(21) Appl. No.: 18/272,178

(22) PCT Filed: Nov. 17, 2021

(86) PCT No.: PCT/RU2021/050380
§ 371 (c)(1),
(2) Date: Jul. 13, 2023

(87) PCT Pub. No.: WO2022/154693
PCT Pub. Date: Jul. 21, 2022

(65) Prior Publication Data
US 2024/0102654 A1 Mar. 28, 2024

(30) Foreign Application Priority Data
Jan. 13, 2021 (RU) ..... RU2021100530

(51) Int. Cl.
*F23R 3/16* (2006.01)
*F23R 3/12* (2006.01)
(Continued)

(52) U.S. Cl.
CPC ..... *F23R 3/12* (2013.01); *F23R 3/16* (2013.01); *F23R 3/346* (2013.01); *F23R 3/54* (2013.01);
(Continued)

(58) Field of Classification Search
CPC ..... F23R 3/12; F23R 3/14; F23R 3/16; F23R 3/34; F23R 3/346; F23R 3/54; F23R 3/58; F23R 2900/00015
See application file for complete search history.

(56) References Cited

U.S. PATENT DOCUMENTS 3,851,465 A * 12/1974 Verdouw ..... F23R 3/04 60/755
3,859,786 A * 1/1975 Azelborn ..... F23R 3/007 60/39.23
(Continued)

FOREIGN PATENT DOCUMENTS

EP 0780638 B1 9/2003
EP 2888531 B1 6/2020
(Continued)

OTHER PUBLICATIONS

Website: A revolution in combustion technology for Gas Turbines. (2024). https://www.psm.com/retrofits-and-upgrades/flamesheet-for-e-and-f-class; last accessed May 2, 2024.
(Continued)

*Primary Examiner* — William H Rodriguez
(74) *Attorney, Agent, or Firm* — The Roy Gross Law Firm, LLC; Roy D. Gross

(57) ABSTRACT

An invention relates to devices for combustion of gaseous fuels, in particular to vortex burners. The technical result consists in simplification of the burner design, allowing to reduce the temperature of the inner surface of the flame tube and, thus, to eliminate the need for expensive thermal
(Continued)

protection coating, as well as in improving the stabilization of the combustion process and implementation of the possibility of combustion at higher excess air factors (poor mixtures) due to the formation of a countercurrent vortex flow inside the flame tube. The burner with the two-layer vortex countercurrent flow contains a cylindrical burner body, a flame tube, and a nozzle coaxially installed therein, wherein an air duct is provided between the burner body and the flame tube; the flame tube contains a front wall having an inlet window and a rear wall having the nozzle; the burner body contains an inlet window fuel feeder, whereas the air duct at the inlet window contains a swirl nozzle, with an additional swirl nozzle and an additional fuel feeder located at the rear wall, and the nozzle is partially placed inside the flame tube.

1 Claim, 1 Drawing Sheet

(51) Int. Cl.

| | |
|---|---|
| ***F23R 3/34*** | (2006.01) |
| ***F23R 3/54*** | (2006.01) |
| *F23R 3/14* | (2006.01) |
| *F23R 3/28* | (2006.01) |
| *F23R 3/58* | (2006.01) |

(52) U.S. Cl.
CPC ..... *F23R 3/14* (2013.01); *F23R 3/286* (2013.01); *F23R 3/58* (2013.01)

(56) References Cited

U.S. PATENT DOCUMENTS

| | | | | | |
|---|---|---|---|---|---|
| 3,872,664 | A * | 3/1975 | Lohmann | F23R 3/346 | 431/9 |
| 4,012,904 | A * | 3/1977 | Nogle | F23R 3/34 | 60/737 |
| 4,062,182 | A | 12/1977 | Fehler et al. | | |
| 4,429,538 | A * | 2/1984 | Sato | F23R 3/12 | 60/755 |
| 5,140,820 | A * | 8/1992 | Booz | F23R 3/12 | 60/737 |
| 5,411,394 | A * | 5/1995 | Beer | F23C 9/00 | 431/9 |
| 5,487,274 | A * | 1/1996 | Gulati | F23R 3/16 | 60/725 |
| 6,263,663 | B1 * | 7/2001 | Grienche | F23R 3/26 | 60/794 |
| 6,735,949 | B1 * | 5/2004 | Haynes | F23R 3/283 | 60/750 |
| 8,272,219 | B1 * | 9/2012 | Johnson | F23R 3/50 | 60/750 |
| 11,835,236 | B1 * | 12/2023 | Nath | F23R 3/54 | |
| 12,007,117 | B1 * | 6/2024 | Boardman | F23R 3/286 | |
| 2006/0107667 | A1 * | 5/2006 | Haynes | F23R 3/346 | 60/737 |
| 2010/0170252 | A1 | 7/2010 | Venkataraman et al. | | |
| 2017/0023251 | A1 * | 1/2017 | Leparoux | F23R 3/002 | |
| 2020/0271319 | A1 * | 8/2020 | Chen | F02C 7/22 | |
| 2020/0271320 | A1 * | 8/2020 | Chen | F23R 3/50 | |
| 2022/0003414 | A1 * | 1/2022 | Chen | F23R 3/12 | |

FOREIGN PATENT DOCUMENTS

| | | | | |
|---|---|---|---|---|
| EP | 4279806 | A1 | 11/2023 | |
| RU | 2196940 | C1 | 1/2003 | |
| RU | 2212003 | C1 | 9/2003 | |
| RU | 2307985 | C1 | 10/2007 | |
| RU | 73947 | U1 | 6/2008 | |
| RU | 2333422 | C2 | 9/2008 | |
| RU | 2708011 | C1 | 12/2019 | |
| RU | 2740240 | C1 | 1/2021 | |
| RU | 2757705 | C1 * | 10/2021 | F23D 14/02 |
| WO | WO-2024079656 | A1 * | 4/2024 | |

OTHER PUBLICATIONS

Shrivastava, A., Patel, V.K. Effect of injection angle of primary and secondary holes on the mixing and combustion in a can type combustor using CFD. SN Appl. Sci. 1, 786 (2019). https://doi.org/10.1007/s42452-019-0753-4.

Razak, A. M. Y. (2007). Gas turbine combustion. Industrial Gas Turbines, 137-173. doi:10.1533/9781845693404.1.137.

* cited by examiner

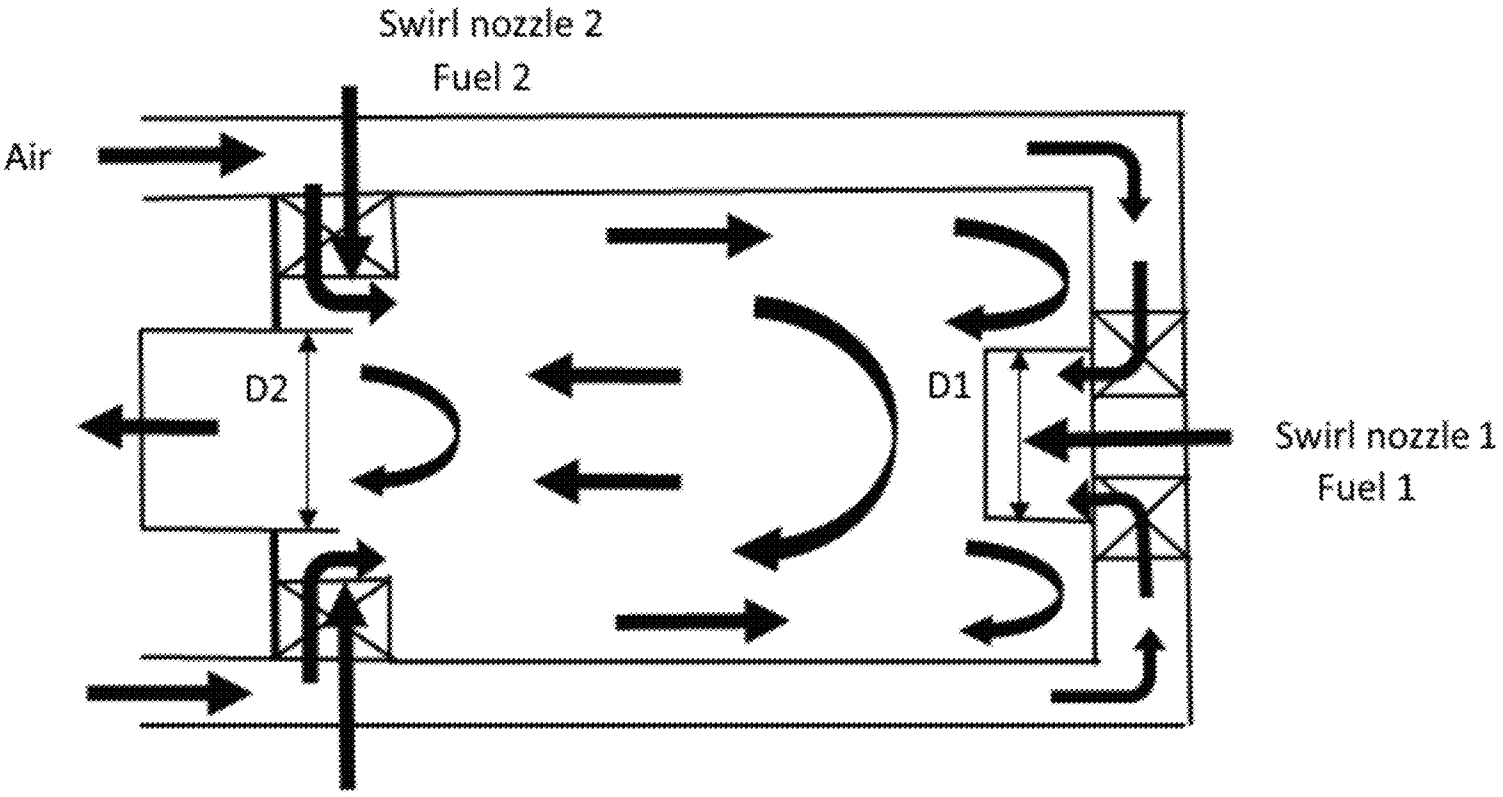
Swirl nozzle 2
Fuel 2
Air
D2
D1
Swirl nozzle 1
Fuel 1

BURNER WITH TWO-LAYER VORTEX COUNTERCURRENT FLOW

CROSS REFERENCE TO RELATED APPLICATIONS

This application is a National Phase application of PCT Patent Application No. PCT/RU2021/050380 having International filing date of Nov. 17, 2021, which claims the benefit of priority of Russian Patent Application No. 2021100530 filed on Jan. 13, 2021. The contents of the above applications are all incorporated by reference as if fully set forth herein in their entirety.

FIELD OF THE INVENTION

The invention relates to devices for combustion of gaseous fuels, in particular to vortex burners.

BACKGROUND

The burner developed by PSM is known from the background art and is used in gas turbine plants (see 'A Revolution in Combustion Technology for Power Generation Gas Turbines, FlameSheet, Power Systems Mfg., LLC', Edition 11/2020). The known burner contains a cylindrical burner body and a flame tube coaxially located therein, in which the combustion process takes place, wherein the flame tube is separated from the body by two air ducts, one of which runs along the inner surface of the burner body and the other along the outer surface of the flame tube. At one end of the housing there is a nozzle, through which the fuel is supplied. The air from the first duct is passed through the swirl nozzle at the beginning of the flame tube, mixed with fuel to produce the first fuel-air mixture, and fed into the flame tube. From the second duct, swirling air or fuel-air mixture (if such a mixture is fed into the second duct) is also fed to the beginning of the flame tube and mixed with the first mixture; after their ignition, the combustion products exit into the nozzle at the other end of the flame tube. The two-layer supply of swirling air and fuel allows for consistent control of the burner's operating modes and consequently extends its performance. In particular, at partial (fractional) load, only the first duct or the first combustion stage can be operated, and when the load of the gas turbine unit increases, the fuel control in the second duct is connected. This optimizes the fuel distribution for improved environmental performance at nominal and partial loads and extends the burner's operating range at partial loads (so-called Turndown).

The specified burner is the closest in technical essence to the claimed invention and was used as a prototype.

The disadvantages of the prototype include the complexity of manufacturing and the lack of cooling of the inner surface of the flame tube, which requires the use of expensive heat protective coating.

SUMMARY

The technical result of the claimed invention consists in simplification of the burner design with the two-layer vortex countercurrent flow, allowing to reduce the temperature of the inner surface of the flame tube and, thus, to eliminate the need for expensive thermal protection coating, as well as in improving the stabilization of the combustion process and implementation of the possibility of combustion at higher excess air factors (poor mixtures) due to the formation of a countercurrent vortex flow inside the flame tube.

This result is due to the fact that the burner with the two-layer vortex countercurrent flow contains a cylindrical burner body, as well a flame tube and a nozzle coaxially installed therein, wherein an air duct is provided between the burner body and the flame tube; the flame tube contains a front wall having an inlet window and a rear wall having a nozzle; the burner body contains an inlet window fuel feeder, the air duct at the inlet window contains a swirl nozzle, with an additional swirl nozzle and an additional fuel feeder located at the rear wall, and the nozzle is partially placed inside the flame tube.

The additional swirl nozzle at the rear wall of the flame tube creates the peripheral vortex air movement near the inner surface of the tube, thus the surface of the flame tube is washed with "cold" air from two sides: from the air duct side and from the vortex created inside by the additional swirl nozzle, resulting in lower surface temperatures and eliminating the need for expensive heat protective coating. In addition, the reversal of the peripheral vortex at the front wall of the flame tube provides the stable zone of flame stabilization and combustion process in the near-axis part of the flame tube.

The burner design and its operation principle will be described in detail below.

BRIEF DESCRIPTION OF THE DRAWINGS

The invention is explained by the FIGURE showing a structural diagram of the proposed burner with a two-layer vortex countercurrent flow.

DETAILED DESCRIPTION OF EMBODIMENTS OF THE INVENTION

The claimed burner contains a cylindrical burner body, a flame tube in which the combustion process takes place, and a nozzle through which the combustion products exit. The flame tube and nozzle are coaxially located in the cylindrical burner body.

The flame tube has front and rear walls. The front wall contains the inlet window, which may be in the form of the regular hole in the wall or the ring mounted therein. The nozzle is mounted on the rear wall, wherein, in one embodiment of the invention, the nozzle is mounted so that it is partially located inside the flame tube (see FIGURE), preventing the leakage of gases directly into the nozzle after leaving the additional swirl nozzle.

The flame tube is installed with a gap to the burner body, forming the air duct through which air is supplied to the flame tube. The swirl nozzle is installed in the air duct at the inlet window of the flame tube and creates the near-axis vortex flow inside the tube. In addition, the flame tube contains an additional swirl nozzle located near the rear wall which forms a peripheral vortex flow inside the flame tube, the direction of this flow being opposite to the direction of the near-axis flow formed by the first swirl nozzle (resulting in a two-layer flow inside the tube).

The burner contains two fuel feeders, which supply fuel to the respective swirl nozzle and mix it with the air therein before ignition.

The burner elements can be made from various materials used in already known burners, such as heat-resistant steels.

Various devices may be used as a fuel feeder to provide fuel to the interior of the flame tube. An example of such a device is a variety of nozzles for liquid or gaseous fuels.

The fuel used in the claimed burner may be a gaseous (e.g., methane, propane, or other fuel with a high hydrogen content (up to 60-80% by weight)) or liquid (e.g., diesel or kerosene) high-calorie fuel.

Disclosed below is the principle of operation of the burner with a double-layer vortex countercurrent flow; the structural diagram of one embodiment of the burner is shown in the accompanying FIGURE, where arrows indicate the directions of gas flow.

Pressurized air is supplied to the air duct. Air passing through the swirl nozzle (swirl nozzle 1) installed at the inlet window is swirled and mixed with fuel (fuel 1) supplied by the fuel feeder, forming the near-axis vortex flow of the ignitable combustible mixture (fuel-air mixture) inside the flame tube. Also, air from the air duct enters the additional swirl nozzle (swirl nozzle 2) located near the rear wall, where it is mixed with fuel (fuel 2) supplied by the additional fuel feeder. After passing the additional swirl nozzle, the resulting mixture forms the peripheral vortex flow directed towards the front wall; once the flow reaches the wall, it joins the near-axis flow. The ignited mixture in the near-axis flow leaves the flame tube through the nozzle.

In the proposed design the body of the flame tube is washed by air from both sides (from the side of the air duct and the peripheral vortex); as a result, the surface is not heated to high temperatures and does not require additional measures for its cooling, in particular, the application of expensive heat protective coating. In addition, the use of a countercurrent vortex flow improves stabilization of the combustion process in the near-axis vortex and allows combustion at higher excess air factors (poor mixtures are used). In this design (unlike the prototype), both the first stage with fuel supply only to the swirl nozzle between the walls and separately the second stage with fuel supply through the additional swirl nozzle can operate equally efficiently at partial loads. In nominal mode, the fuel is fed to both swirl nozzles, ensuring optimum burner operation.

The invention claimed is:

1. A burner with a two-layer vortex countercurrent flow containing:

a cylindrical burner body;

a flame tube;

wherein (i) the flame tube is installed with a gap to the burner body, forming an air duct configured to supply an air to the flame tube; (ii) the flame tube contains a front wall having an inlet window with an inlet window fuel feeder installed therein; (iii) the air duct at the inlet window is connected to a first swirl nozzle configured to create a near-axis vortex flow inside the tube, and (iv) the flame tube further comprises at least one second swirl nozzle connected to the air duct and at least one additional fuel feeder located at a rear wall, said second swirl nozzle being configured to form a peripheral vortex flow inside the flame tube, the direction of the peripheral vortex flow being opposite to the direction of the near-axis vortex flow.

* * * * *